US006259765B1

(12) United States Patent
Baptist

(10) Patent No.: US 6,259,765 B1
(45) Date of Patent: Jul. 10, 2001

(54) X-RAY TUBE COMPRISING AN ELECTRON SOURCE WITH MICROTIPS AND MAGNETIC GUIDING MEANS

(75) Inventor: Robert Baptist, Jarrie (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/445,445

(22) PCT Filed: Jun. 12, 1998

(86) PCT No.: PCT/FR98/01236

§ 371 Date: Dec. 13, 1999

§ 102(e) Date: Dec. 13, 1999

(87) PCT Pub. No.: WO98/57349

PCT Pub. Date: Dec. 17, 1998

(30) Foreign Application Priority Data

Jun. 13, 1997 (FR) ..... 97 07342

(51) Int. Cl.[7] ..... H01J 35/14; H01J 35/06

(52) U.S. Cl. ..... 378/136; 378/122; 378/138; 313/309; 313/336; 313/351

(58) Field of Search ..... 378/136, 106, 378/122, 138; 313/309, 338, 351

(56) References Cited

U.S. PATENT DOCUMENTS 3,518,433 * 6/1970 Owen ..... 378/106
3,665,241 * 5/1972 Spindt et al. ..... 313/351
3,783,288 * 1/1974 Barbour et al. ..... 378/106
3,883,760 * 5/1975 Cunningham, Jr. ..... 378/122
4,012,656 * 3/1977 Norman et al. ..... 378/122
4,979,199 * 12/1990 Cueman et al. ..... 378/121
5,729,583 * 3/1998 Tang et al. ..... 378/136
5,995,849 * 9/1999 Tang et al. ..... 313/336
6,031,250 * 2/2000 Brandes et al. ..... 313/336

OTHER PUBLICATIONS

Klee et al., "Surprising but Easily Proed Geometric Decompostion Theorem," Mathematics Magazine, vol. 71, No. 1, Feb. 1998.*

Cha–Mei Tang, et al., Navy Case No. 75,216, Serial No. 201,963, 50 pages, "Cold Field Emitters With Thick Focusing Grids," Feb. 25, 1994.

* cited by examiner

*Primary Examiner*—Robert H. Kim
*Assistant Examiner*—Drew A. Dunn
(74) *Attorney, Agent, or Firm*—Oblon, Spivak, McClelland, Maier & Neustadt, P.C.

(57) ABSTRACT

An X-ray tube including an electron source and a magnetic guide. The X-ray tube includes at least one electron source, at least one microtip, and an extraction grid, one zone of which emits electrons. Further provided are at least one anode, one zone of which emits X-rays under the impact of the electrons, and a magnetic guiding device for the electrons, capable of creating a magnetic field which is homogeneous at least between the zones. Such an X-ray tube may find application to X-ray absorption analysis or X-ray fluorescence analysis.

9 Claims, 3 Drawing Sheets

X-RAY TUBE COMPRISING AN ELECTRON SOURCE WITH MICROTIPS AND MAGNETIC GUIDING MEANS

BACKGROUND OF THE INVENTION

1. Field of the Invention

The present invention relates to an X-ray tube comprising a microtip electron source.

The invention applies most especially to X-ray absorption analysis through thin objects or thin layers, for example for taking radiographic observations of thin objects with a very good resolution, provided the X-rays source (which forms part of the tube and is the point from which X-rays are emitted) is extremely well defined, i.e. has clear-cut edges and/or controlled intensity over the whole of the zone of emission; this zone of emission can be of small dimensions or conversely very extended.

The invention also makes it possible to X-ray liquids circulating in underground piping of very small dimensions and small thickness.

It is further applicable to the medical field and in particular to mammography from a localized source of X-rays.

The invention also applies to X-ray fluorescence analysis.

It is true that low-energy X-rays have short trajectories. It is nevertheless possible to make a fluorescence analysis of light elements (Ca, Mg etc.) by means of "soft" X-rays generated in a tube according to the invention, and with great spatial accuracy, provided the X-ray source is extremely well defined.

In the case where the source of electrons present in a tube according to the invention is constituted of several sources of electrons separated from one another, it is possible, by exciting these sources one after the other, to make a series of several images in order to observe a sample from several angles.

The thickness or the shape of this sample may then be known with greater accuracy than with a conventional X-ray tube.

2. Discussion of the Background

The principle of the generation of X-rays in a conventional X-ray tube is well known.

It is based on the production of X-radiation when a sufficiently energetic electron bombards an atom of the tube's target.

In a conventional X-ray tube, a potential difference (of at least 50 kV for high energy tubes) is applied between the thermo-ionic cathode (usually, a very hot tungsten filament) and the tube's anode.

The current extracted from the filament strikes the anode (on a surface which is more or less well defined depending on the configurations and the means of focussing with which the tube is equipped), which generates the X-rays at the points of impact.

The anode can be subject to high voltage and the filament to a potential close to earth, or the anode can be at earth potential and the filament negatively polarised.

Only the potential difference counts.

The choice of the potential reference is thus free.

In a case where the anode is at earth potential and the filament negatively polarized, the anode is more easily cooled (hydraulically) to evacuate the heat dissipated by the electrons penetrating into the target (anode) material since the potential of this target is 0V, i.e. is equal to the potential of the water evacuated by pipes.

An X-ray tube of this type has the structure of a diode.

More complex tubes may include, as well as the anode and the filament, an intermediate grid the role of which is explained below.

Since the filament is hot (and therefore capable of emitting electrons), the grid potential is sufficiently close to that of the filament, so that the electron cloud emitted by the filament remains held in the zone between the filament and the grid.

The sudden increase in the potential of this grid makes it possible to extract the electron cloud from this zone, and to let it reach the anode through the grid.

This grid is thus used as an "electron gate valve".

It must not be mistaken for the extraction grid included in microtip cathodes, which provides extraction of the electrons according to quite a different physical principle (the field effect).

In other known X-ray tubes, the electrons are provided by the field effect by means of the use of pointed needles.

The configuration is then that of a diode (the electrical field is the result of the potential difference which exists between the anode and the needles).

However, because of the rapid wearing out of these needles, these other tubes were not as successful as expected.

In conventional X-ray tubes, a certain focussing of the electrons is in general provided by a suitable configuration of the anode-filament assembly.

The electrons leave a certain zone of the cathode and reach the anode in a zone whose surface is limited.

The configuration of the anode-cathode assembly is best defined by calculating the trajectories of the electrons in the region situated between the anode and the cathode, using the formulae of electronic optics.

However, the shape of the filaments (cathodes) does not always make it possible to have an impact of predetermined shape on the anode, and consequently the X-ray source, whose extension corresponds to the impact zone of the electrons, suffers from this defect.

Electron guns for X-ray tubes are also known which allow increased focussing of the electron beams.

In this case, X spots of smaller or better defined size are generated.

If, for example, the electron beam of an electron microscope (having a submicronic diameter) is used, and if this beam is directed at a target, the result is the equivalent of a circular-shaped microfocus X-ray tube.

Such an electron microscope used as an X-ray tube generally has an electron gun equipped with magnetic and electrostatic lenses in order to focus the electron beam on a small surface.

Microtips are also known for their use in flat screens or in certain instruments such as pressure gauges.

Cathodes having a matrix structure and a large surface which use microtips are also known, as is their use inside flat screens as electron sources for the production of visible light by cathodoluminescence.

It is also known from the American patent application of Cha-Mei Tang et al., serial number 201,963, of Feb. 25, 1994, that an X-ray tube could include a microtip cathode and electrostatic focussing means which are incorporated in the cathode itself. Such a structure does not make it possible to obtain an extended, well delimited emitter zone, having a controlled intensity over the whole zone.

Furthermore, the structure of X-ray tubes with filaments does not make it possible to define any specific shape of the X-rays source, i.e. the zone of the tube from which the X-rays are emitted, in an accurate and controllable fashion.

SUMMARY OF THE INVENTION

The aim of the present invention is to remedy these disadvantages.

Its object is an X-ray tube comprising:

at least one electrons source one zone of which, called the first zone, is intended to emit electrons, at least one anode one zone of which, called the second zone, is intended to emit X-rays under the impact of these electrons, and guiding means or focussing means (focussing being taken here in the broad sense of "guidance") on to this second zone of the electrons emitted by the first zone, this X-ray tube being characterized in that the electrons source is an electrons source with at least one microtip and with an extraction grid, and in that the guiding means of the electrons are magnetic guiding means capable of creating a magnetic field which is homogeneous (i.e. which has a direction and intensity which are substantially constant or slowly variable spatially) at least in the volume between the first and second zones, the vectorial characteristics (intensity, direction) of this field being such that the second zone is homothetic to the first zone.

The invention makes it possible to obtain a X-radiation source (second zone) having the shape, the distribution of intensity (number of X photons emitted per second per unit of surface) or the desired uniformity of emission by judicious selection of the magnetic field (for example parallel to the mean direction of propagation of the electrons) and the shape of the emitter cathode (first zone).

In other words, the combination on the one hand of a microtip source, whose geometry and distribution of microtips in the source are adapted to the geometry and the distribution of the desired X-radiation and, on the other hand of magnetic guiding means, whose intensity and direction are adapted to the homothetic (identical or inferior or superior) reproduction of the emitter zone of the electrons both spatially and in intensity, makes it possible to obtain an X-ray tube whose intensity and geometry are perfectly defined.

In particular, the intensity obtained can be spatially variable or constant.

The direction of the field corresponds to the straight line passing through on the one hand the centre of the zone emitting the electrons, and on the other hand the centre of the zone emitting X-rays.

It should be noted that, in order to have an identical reproduction on the anode of the zone emitting the electrons, the intensity of the magnetic field must be greater than or equal to a threshold beyond which there always exists a beam of electrons whose envelopes of the trajectories are parallel.

Since it uses a microtip of a plurality of microtips to emit the electrons, the X-ray tube which is the object of the invention has in particular the following advantages as compared with a conventional X-ray tube using a filament which emits electrons:

There is no pollution of the anode by material which has evaporated from a hot cathode, therefore there is no longer any need to "hide" the filament with respect to the anode; the cathode with microtips(s) can be positioned facing this anode.

The construction of the tube is simpler.

The electron source gives off no heat and thus the anode cannot melt, at least at low power.

The cathode can be pulsed (the length of the pulses can be well below 1 $\mu$s and can even reach 100 ps), and this ability to pulse the cathode is accompanied by extremely flexible electronics, which do not affect the high voltage circuits.

The tube can be connected to a battery.

The zone irradiated by the electrons can be so irradiated uniformly (which is not the case with a filament); the X-rays source is thus uniform (or of controlled uniformity) and the edges of a large emitter zone are clear-cut.

The number of connections (vacuum-tight lead-throughs) remains small by comparison with a tube in which focussing is provided by supplementary electrodes.

In the X-ray tube which is the object of the invention, the electron source can comprise a single microtip or a plurality of microtips depending on the desired geometry and intensity of the X-ray emitter zone.

According to another variant, the X-ray tube includes a plurality of electron sources, an X-ray emitter zone corresponding to each electron source.

The tube, the object of the invention can comprise one anode or a plurality of anodes, each anode then being associated with at least one microtip.

The electron source can be pulsed so as to obtain X-ray pulses.

The X-ray tube, the object of the invention can further comprise an electrically conductive grid which is positioned between the electron source and each anode, this grid being polarized so as to prevent the ions from reaching the electron source and to avoid the formation of electric arcs between this electron source and each anode.

The magnetic guiding means, of the tube, the object of the invention can comprise one or more magnets or Helmholtz coils or both magnets and Helmholtz coils.

BRIEF DESCRIPTION OF THE DRAWINGS

The present invention will be better understood by reading the description of example embodiments given below, purely as examples and in no way exhaustive or limiting, and referring to the appended drawings in which.

DESCRIPTION OF THE PREFERRED EMBODIMENTS

Figure 1:
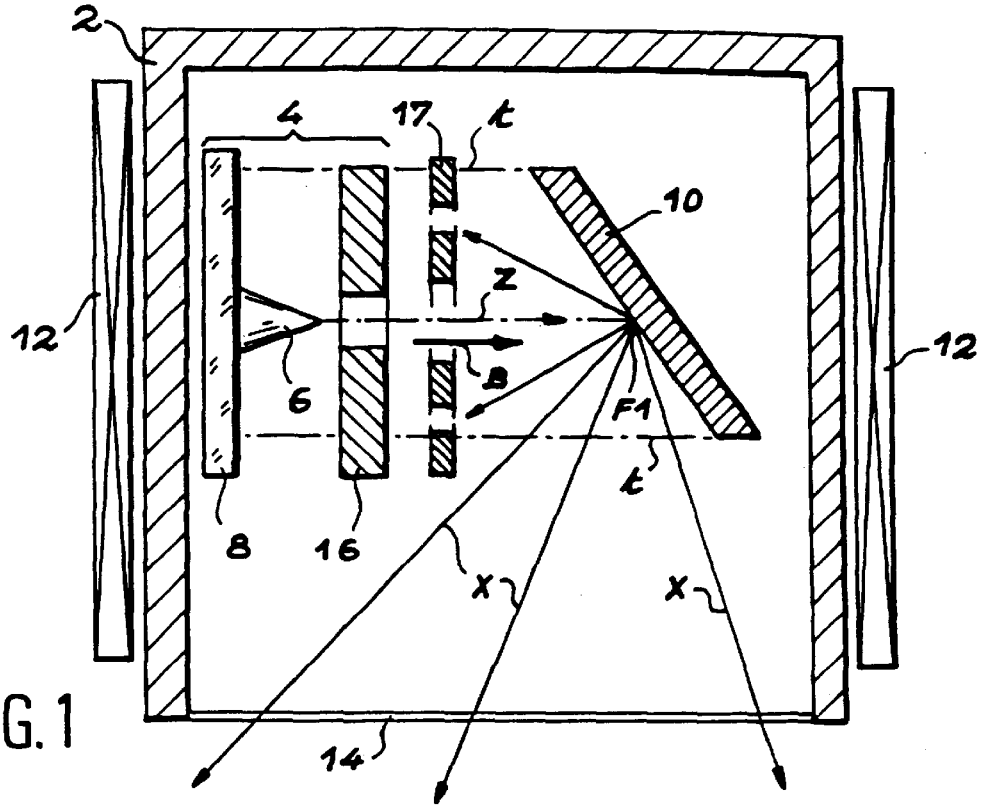
FIG. 1 is a diagrammatic view of a specific embodiment of the X-ray tube, the object of the invention, wherein the electron source comprises only a single microtip.

In the invention, to guide the electron beam emitted by the microtip electron source and to direct this beam to a determined place, a magnetic field is used, the intensity of which can go from a few hundredths of a tesla to a few tenths of a tesla, for example, this magnetic field being, in the case of an identical reproduction of the electron emitter zone, parallel to the median trajectory of the electron beam.

In the rest of the description, for the sake of simplicity, the case of a parallel field is considered.

It is well understood that the insertion can use a divergent or convergent field to reproduce the said electron source zone in an enlarged or a reduced way.

It is known that the trajectories of the electrons then wind around the direction of the magnetic field with a radius, the value which is inversely proportional to the intensity of this magnetic field.

The average trajectories of the electrons are then substantially parallel and scarcely diverge at all.

The zone called "spot" in which the electron beam meets the anode is then identical to the zone in the source which emits the electrons if it is assumed that the anode is placed perpendicularly to the electron beam.

The shape of the emitter zone of the electron source (cathode) is thus reproduced on the anode and the X-ray source thus has strictly this same shape.

The density of X-ray emission depends on the density of the incident current, which in turn depends on the density of the microtips on the cathode and on the current emitted by each microtip.

A more complex magnetic configuration could if appropriate produce greater concentration of the electron beam rather than simply preventing it from diverging.

In this case the "spot" formed on the anode can be even smaller.

In the examples described below the zone which emits the X-rays has a shape which is homothetic with that of the zone which emits the electrons if no account is taken of the angle of incidence of the electrons on the anode (when the latter is different from 90°). This can in any case be corrected by giving the electron emitter zone a shape such that when projected on to the anode the spot obtained has the desired shape.

It should also be noted that the X-rays generated at the surface of the anode are emitted isotropically.

Some of them escape from the anode while others penetrate more deeply into it.

If this anode is thick, the only usable X photons are those emitted out of the anode.

In each of the examples diagrammatically shown in FIGS. 1 to 4, an X-ray tube is provided with a window made of a material selected to be as non-absorbent as possible with respect to X-rays so that they can pass through this window and leave the tube, or as thin as possible to limit absorption (a membrane of nanometric thickness made of $Si_3N_4$ or SiC can be used).

This window also maintains the airtightness of the enclosure of each X-ray tube, in which enclosure is created (by means not shown in FIGS. 1 to 4) a pressure which is sufficiently low (for example of the order of $10^{-8}$ hPa or less) so that the X-ray tube will operate correctly and durably.

In one specific embodiment not shown the X-ray tube is itself under vacuum (for example in the case of an electron microscope) and this window is then eliminated or it acts only as an optical filter or a pollution filter and the X-rays produced are then propagated in vacuo and irradiate a sample also placed in vacuo.

FIG. 1 is a diagrammatic view of a first example of the X-ray tube according to the invention.

The X-ray tube diagrammatically represented in this FIG. 1 comprises in an enclosure under vacuum 2, an electron source 4 comprising a single microtip 6, made of an electron-emitting material and formed on an appropriate substrate 8, and an incorporated extraction grid 16, the source being preferably made using the techniques of microelectronics.

In the enclosure 2 there is also a single metallic anode 10 placed opposite the microtip 6.

Means not illustrated are provided to bring this anode 10 to a high positive voltage with respect to the microtip 6.

The X-ray tube in FIG. 1 also comprises Helmholtz coils 12 preferably placed outside the enclosure 2 (which is made of an anti-magnetic material) these coils being provided for creating a magnetic field B which is substantially parallel to the axis Z of the microtip and which is homogeneous within the volume between the microtip and the anode 10, this volume being limited by the dot-dash lines t visible in FIG. 1.

Instead of coils 12 it is possible to use one or more magnets to create this magnetic field and this magnet (these magnets) can be placed inside or outside the enclosure 2.

The voltage applied between the anode and the microtip can be of the order of +5 kV to +50 kV.

An electron beam is then emitted by the microtip 6 in the direction of the axis Z towards the anode 10, by means of the application of a voltage to the extraction grid 16.

The microtip 6 is capable of emitting a current of the order of 100 $\mu$A.

This electron beam is concentrated and guided towards the anode 10 by the magnetic field B.

This magnetic field is of the order of a few tenths of a tesla.

Since a single microtip is being used, the electron emitting zone is of the order of 1 $\mu m^2$ or less. The size of the electronic spot on the anode is also of the order of 1 $\mu m^2$ or even less with more intense magnetic fields.

Thus X-rays are generated (referenced X in FIGS. 1 to 4) from a micro-focus F1 whose size is of the order of 1 $\mu m^2$.

As can be seen in FIG. 1, the enclosure 2 is closed by a beryllium window 14.

The X-rays leave the anode 10, pass through the window 14 which is transparent to X-rays and which also ensures the airtightness of the enclosure.

These X-rays are then available for the use desired.

The X-rays generated in the anode 10 which are propagated within the anode (rearwards) are not used.

It should be noted that the microtip source 4 must be located at a suitable distance from the anode 10 so that:

- the returning positive ions (which are propagated in the direction of decreasing potentials) do not damage the source or cathode 4, and
- this cathode does not form a screen or shade to the emitted X-rays.

Preferably, to prevent ions from returning, an intermediate grid 17, which has high transparency to the electrons emitted by the microtip 6, is positioned between the source 4 and the anode 10, near the source 4, in the path of the electron beam, a few millimeters from the source 4.

This grid 17 is for example made of a conductive material and pierced as to 90% to allow the electrons to pass.

Furthermore, this grid 17 is raised (by means not illustrated) to a potential higher than that of the extraction grid 16. It can be either very much lower than that of the anode, for example of the order of 200 V to 500 V, or again, if the grid is extremely transparent to electrons, slightly greater than that of the anode to prevent the positive ions produced at the anode by the impact of the electrons from returning as far as the cathode.

Figure 2:
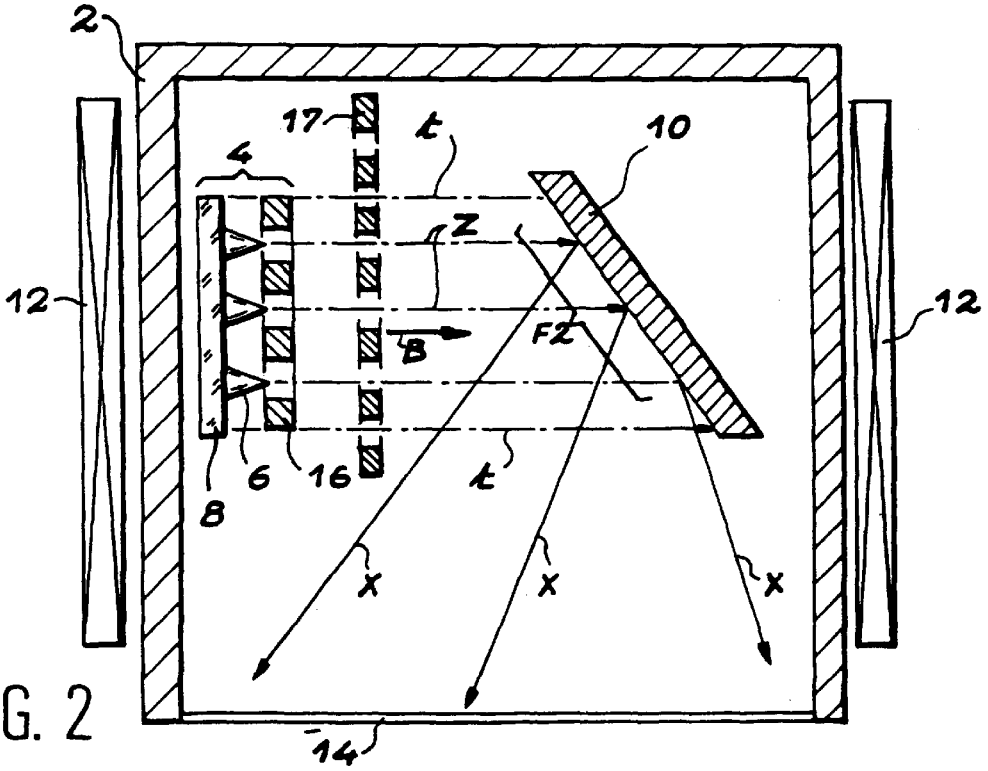
FIG. 2 is a diagrammatic view of another specific embodiment wherein the electron source comprises a number of microtips.

A second example of the X-ray tube according to the present invention is diagrammatically represented in FIG. 2.

The X-ray tube in FIG. 2 is similar to that in FIG. 1, except that in the case of FIG. 2 the electron source 4 comprises a number of microtips 6 which are formed on the substrate 8 and whose axes are substantially parallel.

The anode 10 is once more positioned opposite these microtips.

The magnet or the Helmholtz coils 12 are again provided for creating the magnetic field B which is homogeneous in the volume between 16 the source 4 and the anode 10, this volume being limited by the dot-dash lines t visible in FIG. 2.

This magnetic field is substantially parallel to the axes Z of the microtips.

The magnetic field B guides the electrons emitted by these microtips so that the average trajectory of the electrons is substantially parallel to this magnetic field B in the volume limited by the dot-dash lines t.

Preferably a grid 17 which is transparent to electrons is positioned between the anode 10 and the source 4, a few millimeters from the latter, as is seen in FIG. 2.

Means not illustrated again make it possible to polarize the anode 10 positively with respect to the microtips 6, for example at a voltage of the order of +10 kV, and to raise the grid 17 to a potential higher than that of the grids 16 but much lower than that of the anode 10, or slightly higher than the latter.

The substrate has for example an area of the order of 100 $m^2$ to 1 $mm^2$ and comprises, for example, 100 to 1,000 microtips distributed over a zone with an area equal to 100 $\mu m^2$ and making it possible to obtain an electronic current of the order of 1 mA to 10 mA.

If no account is taken of the space charge of the electron beam, the magnetic guidance makes it possible to obtain an electronic spot F2 on the anode 10 having the same size as the zone occupied by the microtips of the cathode 4 (taking no account of the inclination of the anode 10 with respect to the electron beam).

This inclination of the anode in the X-ray tube in FIG. 2 (as indeed in the case of the X-ray tube in FIG. 1) is provided for sending a large quantity of X-rays in the direction of the beryllium window 14.

It should be noted that in the case of FIGS. 1 and 2, the dimensions of the electronic spots and thus of the X-ray spots on the anode 10 are directly related with the size of the electron sources (single microtip or set of microtips).

It is therefore possible to make X-ray tubes according to the invention in which the X-rays emitting zone has exactly the dimensions and shape desired for the intended application, the distribution of intensity of the X-rays emitting zone being a function of the distribution of the emission intensity of the first zone.

Figure 3:
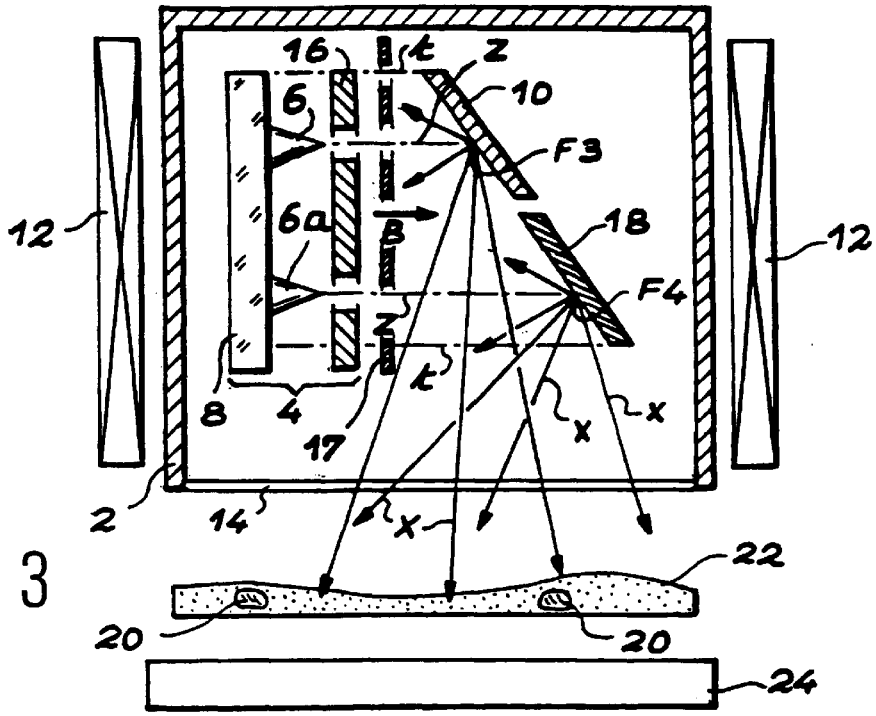
FIG. 3 is a diagrammatic view of another specific embodiment wherein there are a plurality of anodes.

The X-ray tube according to the invention which is diagrammatically represented in FIG. 3 differs from that in FIG. 1 in that in addition to the anode 10, it comprises another anode 18 which is positioned beside the anode 10, and a supplementary microtip 6*a* positioned on the substrate 8, opposite this other anode 18.

In this example there are thus two electron emitting zones and two X-ray emitting zones.

Thus separate electron beams can be generated which are still guided by the magnetic field B, this field being homogeneous in the volume between the microtip sources and the two anodes (this volume being once more limited by the two dot-dash lines t visible in FIG. 3).

These separate electron beams make it possible to generate separate X-ray beams.

The anodes 10 and 18 are similarly inclined with respect to the electron beams, as can be seen in FIG. 3, so that each sends a large quantity of X-rays towards the window 14.

On the other hand, if it were desired to separate the two X-ray beams, the anodes could be differently inclined.

Rather than associating a single microtip with each anode, it would be possible to associate several microtips with it.

The zones F3 and F4 which emit X-rays, respectively situated on the anodes, are homothetic with the two zones which emit electrons (respectively with on microtip or a set of microtips).

The advantage of an X-ray tube of the type shown in FIG. 3 resides in the fact that the two anodes can be made of different materials.

Thus X-rays of different wavelengths can be generated.

The "polychromic" X-ray tube thus obtained enables discriminatory interpretations of certain experiments to be made using X-rays.

It is possible for instance to arrange that the anode 10 emits X-rays the wavelength of which does not enable particles 20 contained in a sample 22 situated outside the X-ray tube, opposite the window 14, to be shown up, a detector 24 being place behind this sample 22 (which is thus between the window 14 and the detector); and also to arrange that the anode 18 emits X-rays the wavelength of which does enable these particles to be shown up.

By subtraction a better knowledge of the nature and localization of the particles 20 contained in the sample 22 is thus obtained.

The tube according to the invention which is diagrammatically represented in FIG. 4, again comprises an enclosure 2 under vacuum closed by a window 14 which is transparent to X-rays and is for example made of beryllium.

In this enclosure there is once more a microtip cathode 4 opposite which is positioned a grid 17 which is transparent to the electrons emitted by the microtips 6.

Figure 4:
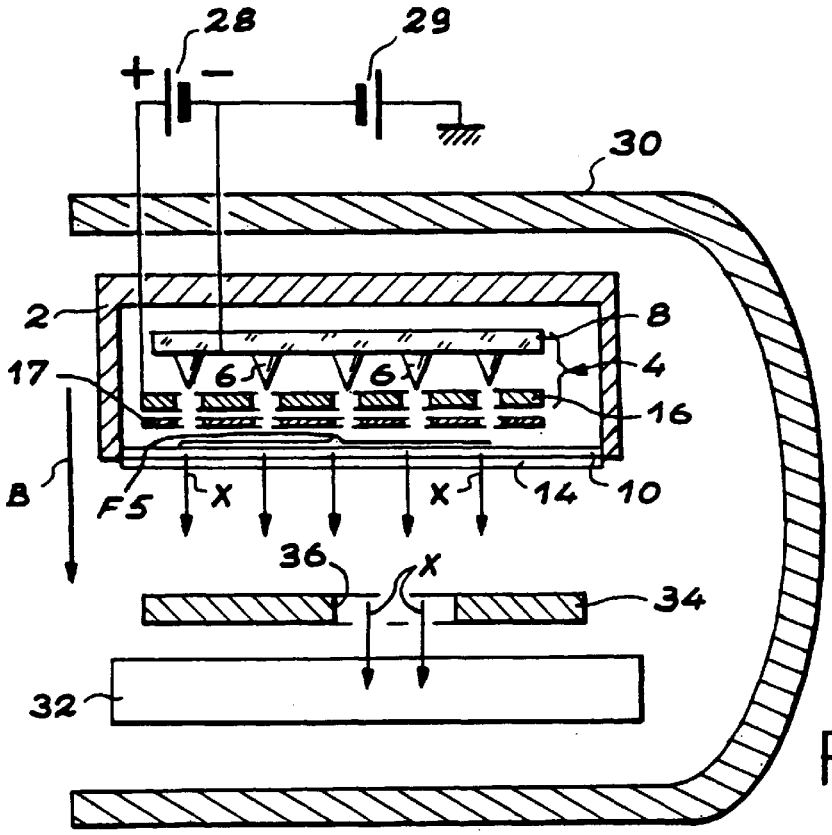
FIG. 4 is a diagrammatic view of another specific embodiment wherein the anode is formed on the window of the tube.

The X-ray tube in FIG. 4 also comprises an anode 10 at earth potential and consisting for example of a layer of tungsten which is deposited on the beryllium window.

Polarisation means 28 are provided to raise the microtips formed on an appropriate substrate 8 to a negative voltage with respect to the extraction grid 16 and means 29 are provided to raise the cathode assembly to a high negative voltage with respect to that of the anode.

The anode 10 formed on the window 14 is positioned opposite the grid 16 and the microtips 6, and this anode is substantially parallel to the substrate 8 and the grid 16.

The X-ray tube in FIG. 4 also comprises a magnet 30 located outside the enclosure 2 and is provided of creating a magnetic field B perpendicular to the anode, homogeneous within the volume between the source 4 and the anode 10 and provided for focussing the electrons emitted by the microtips on to this anode.

When the anode 10 is hit by the electrons emitted by the microtips it emits X-rays which pass through the beryllium window 14.

A spatial X-ray detector 32 is positioned opposite the window 14, outside the enclosure 2 of the X-ray tube.

FIG. 4 also shows a sample screen 34 partially opaque to X-ray, provided with an opening 36 and positioned between the window 14 and the spatial detector 32, the X-rays thus traversing this opening 36 before reaching the detector.

This example illustrates the concept of plane radiography with an extended source X: only the regions of slight absorption (symbolized by the hole 36) allow passage to the X-rays detected by the two-dimensional detector 32.

The X-ray tube in FIG. 4 has an extended focus F5 (zone which emits the X-rays) defined by magnetic guidance, this focus having a uniformity which can be constant or controlled.

With a large enough microtip cathode this zone F5 which emits the X-rays can have an area of tens of $cm^2$.

Such a zone F5, which is by no means selective, is nevertheless perfectly limited by means of the magnetic guidance of the electron beams.

The zone F5 in FIG. 4, which emits the X-rays, has strictly the same degree of extension as the electron emitting zone (set of microtips) although the microtip cathode 4 is separated from the anode 10 by several millimeters.

Any desired shape could be given to the microtip cathode of an X-ray tube according to the invention, for example the shape of a "P".

The X-rays emitting zone would than also have the shape of a "P", which is not feasible with a conventional X-ray tube using an electrode-emitting filament or a thermoionic anode.

An X-ray tube according to the invention can be pulsed.

Generally speaking, the high voltage applied to the anode of this tube may be pulsed, so that the electrons are alternately attracted then repelled by this anode, or the electron source may be pulsed so that the electron beam is alternately emitted and then not emitted.

For instance, the anode may be raised to the high voltage (constant over time) and pulse the microtip cathode to generate electron peak currents of several mA, in the form of pulses reaching a duration of 100 ps or less, and separated by dead times of longer or shorter duration.

In the case of a pulsed tube, the electron beam is still guided by the action of a magnetic field as has been seen from the examples in FIGS. 1 to 4.

Such a pulsed tube can be applied to pulsed X-photography.

In the invention, it is of course possible to use a microtip cathode with a matrix structure and to control successively the various rows of this microtip cathode, which also corresponds to a pulsed mode operation of the X-ray tube of this cathode with matrix structure.

In the present invention, it is possible to use as an anode a plate of aluminium or magnesium or a thin layer of tungsten formed by evaporation on to a heat-conductive substrate (in order to be able to evacuate the heat). The material of the anode is selected from the periodic table of the elements depending on the application.

It should be noted that the window 14 which closes the vacuum enclosure 2 is sufficiently thick to ensure vacuum-tightness but sufficiently thin not to excessively absorb the X-rays emitted when the X-ray tube is operating. For small windows it is possible to use membranes of nanometric thickness.

This window may have a honeycombed structure providing both rigidity and vacuum-tightness and transmission of the X-rays thanks to the lower thickness.

The thickness of this window depends on its diameter and may be of the order of 100 $\mu$m or less in places and in the case of membranes it may be measured in hundreds of nanometers.

If desired, a getter-type element may be placed in this enclosure 2 to maintain a very low pressure.

Figure 5:
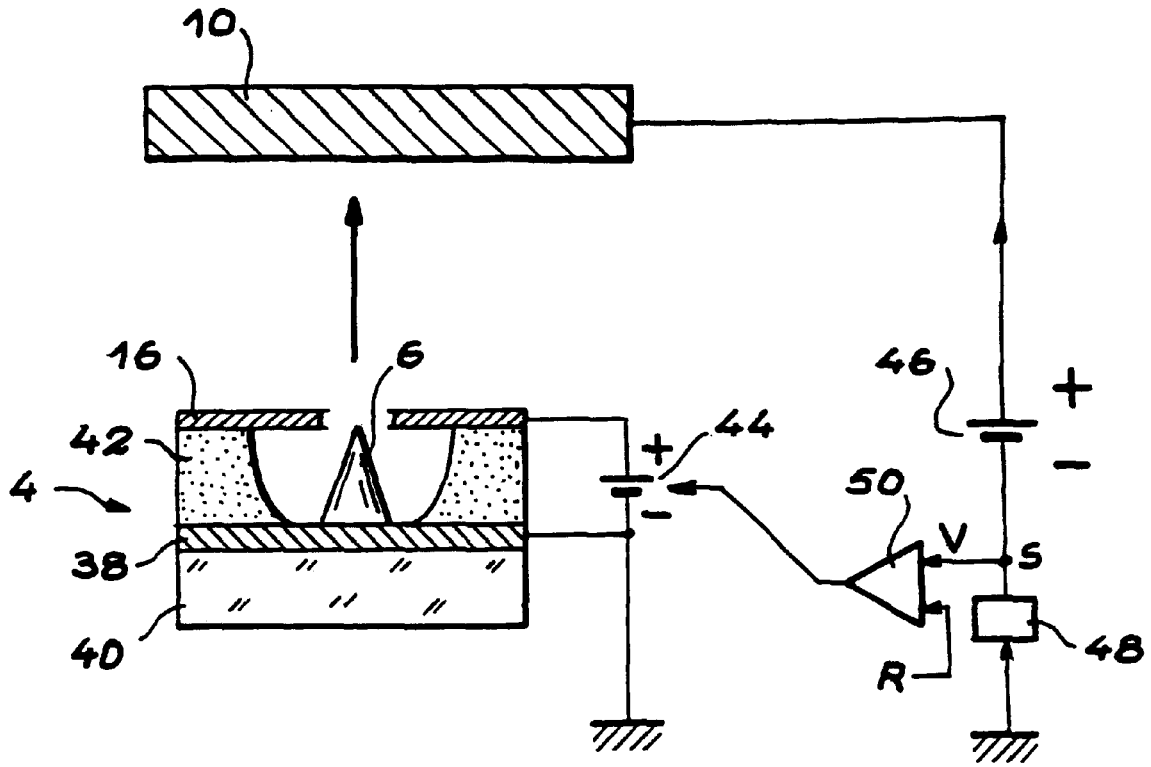
FIG. 5 shows diagrammatically regulating means of the electron source of an X-ray tube according to the invention.

It is possible to associate with an X-ray tube according to the invention a system of regulation of the electronic current emitted by the microtip cathode, as is shown diagrammatically in FIG. 5.

This figure shows the microtip cathode 4, where a single microtip 6 is illustrated, resting on a grounded conductive layer 38.

This layer 38 in turn rests on a silicon substrate 40.

The pierced grid 16 opposite the microtip and electrically insulated from the layer 38 by a layer 42 of $SiO_2$ can also be seen.

The anode 10 of the X-ray tube can also be seen as well as means 44 enabling an appropriate variable positive voltage to be applied to the grid 16 with respect to the microtip 6 and means 46 enabling an appropriate high voltage to be applied to the anode 10 with respect to the microtip.

A resistance 48 of value r is mounted between the earth and the negative terminal of the means 46 for applying the high voltage to the anode.

The regulation system consists of an operational amplifier 50 which controls the means 44 for applying voltage depending on a reference voltage R fixed by the users and on the voltage picture of the current flowing in the resistance 48.

More exactly, the electrons entering the anode 10 correspond to a current of intensity i.

This comes from earth, passes through the resistance 48 and by the supply (application means) 46.

At the terminals of the resistance there exists a voltage V equal to r.i.

This voltage V is passed to the operational amplifier 50 and this latter compares this voltage V with the reference voltage R corresponding to the current desired by the user.

This regulation system is known.

The examples of the invention which have been described by reference to FIGS. 1 to 4 use flat anodes.

However, using another type of anodes, for example cylindrical "rotating anodes" would remain within the scope of the invention.

Journal of Microscopy, vol. 156, n° 2, November 1989, p. 247 to 251 describes an X-ray projection microscope comprising of a microtip electron source and an anode which emits X-rays under the impact of the electrons. Magnetic lens is positioned near the electron source. An electrostatic deflection system is included between the lens and the anode.

U.S. Pat. No. 4,979,199 A describes an X-ray tube comprising an electron-emitting filament and an anode which emits X-rays under the impact of the electrons. A magnetic coil creates a magnetic electron focussing field in a zone between the anode and the cathode.

U.S. Pat. No. 4,012,656 describes an X-ray tube comprising a field-effect emission cathode.

U.S. Pat. No. 3,665,241 discloses the use of a microtip electron source in an X-ray tube.

U.S. Pat. No. 3,518,433 describes an X-ray tube comprising a field emission cathode and an adjacent control electrode.

WO 87/06055 describes an X-ray tube comprising a rotating photo-cathode and a rotating anode which receives the electrons emitted by the photocathode and emits X-rays.

U.S. Pat. No. 3,783,288 describes an X-ray tube with pulsed field emission, comprising a conical anode opposite which a cathode made of spaced needles is positioned, DE 895 481 describes cylindrical electromagnetic lens comprising a split support, such that the density of the lines of force shall be at a maximum in one part of this coil.

EP 0 473 227 describes an X-ray tube comprising a cathode, an accelerating anode, a magnetic lens system to focus the electrons leaving the accelerating anode and an anode constituting a target to produce the X-rays by electronic bombardment.

U.S. Pat. No. 3,883,760 describes a field emission X-ray tube comprising a cathode made of a graphite fabric. Each thread of the fabric comprises filaments of graphite which constitute electron emitters.

What is claimed is:

1. An X-ray tube comprising:

at least one electron source one zone of which, called first zone, is intended to emit electrons;

at least one anode one zone of which, called second zone, is intended to emit X-rays under the impact of these electrons, and guiding means on to this second zone of the electrons emitted by the first zone, this X-ray tube being characterized in that the electron source is an electron source with at least one microtip and with an extraction grid, and in that the guiding means are magnetic guiding means capable of creating a magnetic field which is homogeneous at least in the volume between the first and second zones, the vectorial characteristics of this field being such that the second zone is homothetic with the first zone.

2. An X-ray tube according to claim 1, wherein the electron source comprises a single microtip.

3. An X-ray tube according to claim 1, wherein the electron source comprises a plurality of microtips.

4. An X-ray tube according to claim 1, comprising a plurality of electron sources, a X-rays emitting zone corresponding to each electron source.

5. An X-ray tube according to claim 1, comprising a single anode.

6. An X-ray tube according to claim 1, comprising a plurality of anodes, each anode being associated with at least one microtip.

7. An X-ray tube according to claim 1, wherein the electron source is pulsed so as to obtain X-ray pulses.

8. An X-ray tube according to claim 1, further comprising an electrically conductive grid positioned between the electron source and each anode, this grid being polarized so as to prevent the ions from reaching the electron source and to prevent the formation of electric arcs between this electron source and each anode.

9. An X-ray tube according to claim 1, wherein the magnetic guiding means comprise one or more magnets or Helmholtz coils or both magnets and Helmholtz coils.

* * * * *